United States Patent [19]

Fukui et al.

[11] 4,057,421

[45] Nov. 8, 1977

[54] PROCESS FOR VACUUM DECARBURIZATION OF STEEL

[75] Inventors: Takashi Fukui, Minoo; Takami Ikeda, Nishinomiya, both of Japan

[73] Assignee: Sumitomo Metal Industries Limited, Osaka, Japan

[21] Appl. No.: 713,236

[22] Filed: Aug. 10, 1976

Related U.S. Application Data

[63] Continuation of Ser. No. 516,911, Oct. 22, 1974, abandoned.

[51] Int. Cl.[2] ..... C21C 7/10

[52] U.S. Cl. ..... 75/60; 75/49

[58] Field of Search ..... 75/60, 49

[56] References Cited

U.S. PATENT DOCUMENTS

| | | | |
|---|---|---|---|
| 2,093,666 | 9/1937 | Vogt | 75/49 |
| 3,793,002 | 1/1974 | Borgnat | 75/60 |
| 3,798,025 | 3/1974 | Ramachandran | 75/49 |
| 3,854,932 | 12/1974 | Bishop | 75/49 |
| 3,992,194 | 11/1976 | Leroy | 75/60 |
| 4,001,009 | 1/1977 | Bauer | 75/60 |

*Primary Examiner*—Peter D. Rosenberg

*Attorney, Agent, or Firm*—Watson, Cole, Grindle & Watson

[57] ABSTRACT

A process for the vacuum decarburization wherein oxygen gas is blown downward upon the molten steel surface under reduced pressure from a height apart from said steel surface characterized by applying a Laval nozzle having a divergence calculated from the theoretical Mach number which is, in turn, determined by a definite equation as a lance to provide a desired dynamic pressure on said molten steel surface and a desired depth of impression formed in the molten steel.

In this process, a cooling medium for cooling the lance with a cooling medium sprayed with water.

5 Claims, 10 Drawing Figures

| — MARKS ARE THEORETICALLY EQUIVALENT MACH NUMBER

PROCESS FOR VACUUM DECARBURIZATION OF STEEL

This is a continuation of application Ser. No. 516,911 filed Oct. 22, 1974 and now abandoned.

BACKGROUND OF INVENTION

The present invention relates to a process for the vacuum decarburization of steel by blowing oxygen downwardly upon the molten steel surface under reduced pressure and in particular to such a process using an oxygen lance equipped with special cooling means.

The Witten process of VOD process is a process for refining steel wherein oxygen is blown up the molten steel surface in a closed vessel maintained under reduced pressure while agitating the molten steel by blowing Ar gas through the molten mass to effect decarburization by preventing the oxidation of alloy metals such as Cr, Mn, etc. in the low carbon range. The Witten process is very advantageous economically not only in that the oxidation of Cr, Mn, etc. in the low carbon range is reduced as compared with conventional processes employing, for example, a converter or an electric furnace and by blowing oxygen upon the molten steel under atmospheric pressure. Also the process enables the preparation of extremely low carbon stainless steel which has hitherto been difficult to be prepared commercially by conventional processes due to the oxidation loss of Cr resulted from the markedly high refining temperature.

The Witten process has, however, the following disadvantages:

1. Since the decarburization is carried out in a closed vessel under reduced pressure, its rate is so high that the sampling of molten steel is not only difficult during the course of the reaction but also techniques for the rapid analysis of the molten steel have not been established which can be completed during the process of decarburization.

2. In order to avoid any explosion which may occur due to water leakage, the Witten process employs a consuming type lance which is steel pipe as such or coated with refractory mortar in place of a water cooled lance in a closed vessel under reduced pressure so that the consumption thereof cannot be observed directly but the lance is advanced empirically. Such advance of lance does not always correspond to the actual consumption thereby causing the decarburization rate to fluctuate severely with the change in the height of the lance above the molten steel surface so that the final C value can not be estimated correctly from the vacuum achieved, and, 3. There has been provided a method for estimating the C-value in the molten steel every moment from the carbon amount exhausted from the system by measuring continuously the contents of CO and $CO_2$ in the exhaust gas by gas analyses and the flow rate of the exhaust gas. Since such a method requires calibration due to the gas density since not only the exhaust gas contains moisture but also the composition fluctuates in the course of decarburization to cause substantial error in the calibration. Further, some technical difficulties in the closed vessel used in commercial applications under reduced pressure are encountered in the measurement of flow rate rather than the gas analyses of such an exhaust gas.

There has arisen some problems in vacuum refining with oxygen lancing such that the correct C-value cannot be obtained during the refining process to correctly control it and also the control of the decarburization is difficult. The control of decarburization which has been carried out most generally during the actual operation is to calculate the oxygen amount required for the oxidation of C, Si and the like from the analysis of the molten steel composition prior to the oxygen lancing under reduced pressure, estimating the required oxygen amount with reference to the oxygen efficiency obtained empirically as shown, for example, in FIG. 1, and to control the decarburization from the estimated oxygen demand. In such a method, since the decarburization efficiency of the oxygen depends largely on the temperature, the Si-content prior to the oxygen lancing, the amount of slag, the flow rate of oxygen, the degree of vacuum, the degree of agitation by argon gas and the like, the decarburization has been carried out by calibrating the temperature and silica content empirically, treating the slag so as to provide a uniform slag thickness by removing provisionally, for example, in the ladle and on the basis of the calculated amount of lancing oxygen during the stepwise change in the flow rate of oxygen, degree of vacuum and agitation by means of argon gas in order to minimize the dispersion in the decarburization rate during the heating.

Even though the above-mentioned conditions are intended to be maintained constantly, when the oxygen lance is consumed at a larger speed than that fed into the furnace as mentioned above and oxygen gas is blown onto the molten metal surface from a relatively larger height, it is exhausted without colliding against the molten steel surface. Hence there may occur a case where the exhaust gas includes unburned oxygen gas in a large amount. In such a case, the oxygen efficiency will be decreased to induce some dispersion in the relation between the final C-value and the degree of achieved vacuum due to the variation of unburned oxygen gas during the heating to cause inevitably an error in the estimation of the final C-value based on the degree of vacuum. The amount of unburned oxygen becomes significant when the C-value is reduced to a value of, for example, less than 0.10% during the last stage of decarburization and the amounts of formed CO and $CO_2$ are decreased correspondingly thereto to give a large deviation in the degree of achieved vacuum.

Consequently, the decarburization is carried out to achieve a final C-value lower than the desired value and then carburizing the product to the desired C-value. By using such measures, not only expensive alloy elements such as Cr, Mn, etc. are lost by the oxidation during carburization but also various disadvantages are associated therewithin. For example, the procedure increases the oxygen content of the molten steel thereby deteriorating its quality, promotes loss of refractoriness due to unnecessary temperature increase, prolongs the lancing time and reduces the efficiency of the process.

DETAILED DISCLOSURE OF INVENTION

It is an object of the present invention to provide a process for carburizing to obtain steel of high quality by employing a lance which is placed at a sufficient height above the surface of the molten steel so as not to cause loss of the lance due to its melting and to facilitate cooling the lance with water in order to overcome such disadvantages in a process for blowing oxygen upon the molten steel surface under reduced pressure.

It is another object of the present invention to provide a process for carburizing steel in a vacuum by cooling an oxygen lance with water.

According to the present invention, there is provided an oxygen lance which can be cooled with water mist-containing gas prepared by blowing at a high speed a gas such as air through its cooling medium passage and spraying a small amount of water into the stream.

Cooling the oxygen lance, which is heated by molten steel in a decarburized vessel at an elevated temperature, with water in a minor amount sufficiently not to cause an explosion in the vessel by water leakage resulting from, any damage in the passage of the cooling medium during lancing, is not effective unless the latent heat of vaporization is utilized. Moreover, if water is present in the passage of the cooling medium, steam bubbles may develop on the heat transfer surface due to the limited amount of water supplied and reduce rapidly the heat transfer and melt the lance. Since the present invention employs means for adding micronized water into the cooling gas stream blowing at a high speed, water drops entrained in the gas stream may form a surface layer flowing along the wall of the cooling passage to cool the wall surface thereof and since the developed bubbles are collapsed rapidly by the gas stream to be entrained therein. The water effectively cools the lance notwithstanding its use in an extremely small amount.

Moreover, according to the present invention, two-thirds to three-fourths of the cooling water supplied in such a manner is vaporized to be exhausted from the lance. Even if the lance is damaged during lancing, there is no fear of an explosion caused by the ejection of water into the vessel due to the fact that water is not present in the lance.

According to an embodiment of the present invention, a ladle filled with molten steel is placed in a closed decarburization vessel. At the bottom of the ladle, there is provided a tuyere for blowing argon gas through porous bricks which have been mounted previously to agitate the molten steel. Lancing oxygen is blown through an oxygen lance of steel pipe as such or lined with refractory mortar which is attached to a Laval nozzle at the tip designed to have a speed with a designed Mach number of 3 under pressure of, for example, 100 mm Hg as illustrated by FIG. 2.

Figure 1:
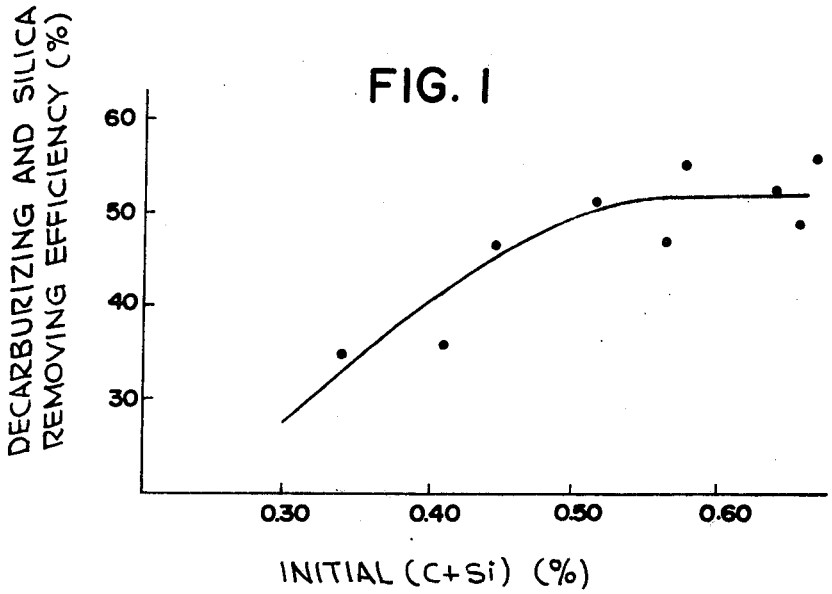
FIG. 1 represents a graph showing the relationship between the initial values of C+Si and the decarburizing and silica removing efficiency.
Figure 2:
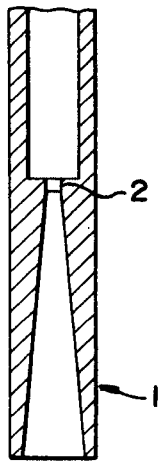
FIG. 2 shows a sectional view of a Laval nozzle employed in the process according to the present invention.

FIG. 2 shows details of lance having a Laval nozzle usable in the process according to the present invention. In this figure, 1 represents a divergent portion and 2 a throat of the nozzle. According to the present invention, there is provided oxygen gas having a high energy (as represented by the dynamic pressure or depth of a depression formed in the molten steel) delivered from an elevated height above the molten steel surface under reduced pressure. The shape the nozzle should be optimum for the purpose. In the Witten process wherein the decarburization is conducted under reduced pressure, the pressure in the vessel fluctuates during the reaction as shown below. It is a routine that from the first stage to the midway stage of the decarburization, oxygen is generally blown under high pressure such as several tens of Torrs, but during the last stage oxygen is blown under lower pressure such as 10 or less Torrs.

In the Witten process, the decarburization begins at a C-value of 0.3 to 0.5%. Since the oxidation of metallic components such as Cr and the like occurs to a minor extent under not so high a degree of vacuum within the range of C-values up to about 0.1%, it is advantageous not to evacuate so highly in order to avoid troubles caused by a high degree of vacuum such as excessive boiling, increased splashing and the like.

When the C-value is reduced to less than 0.1%, it is necessary to evacuate to a high degree of vacuum in order to reduce still further the partial pressure of CO for reducing the C-value to a desired value which depends on the type of steel and is about 0.05% for plain steel and less than 0.02% for extremely low carbon steel. This is the reason why the pressure in the vessel fluctuates during the decarburization in the Witten process.

Figure 3:
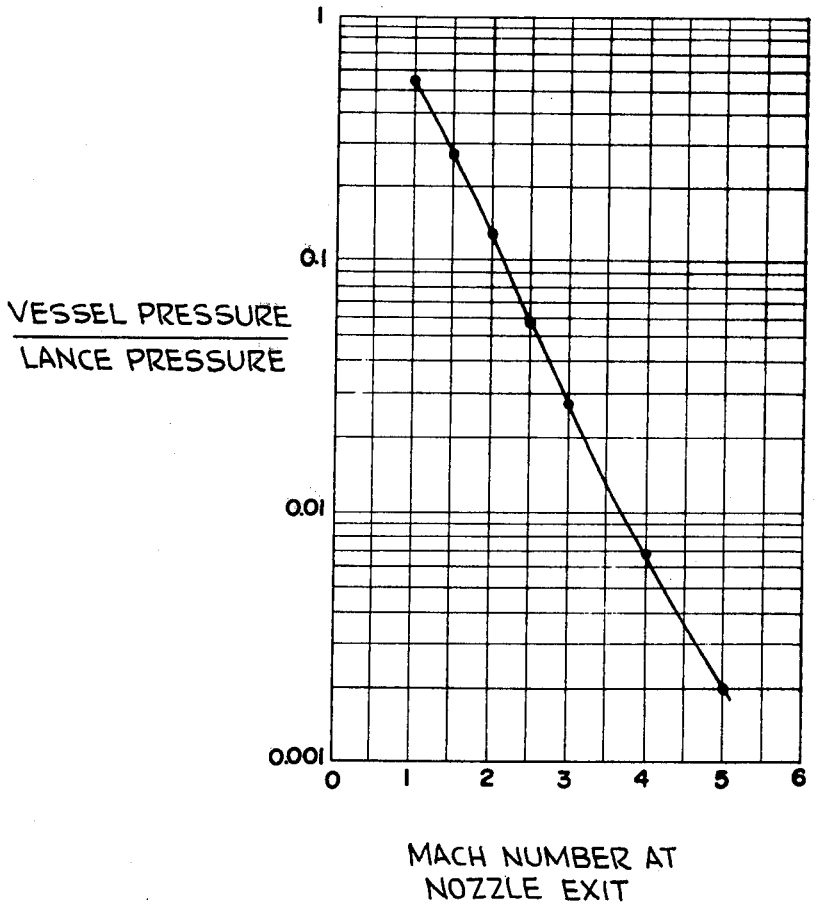
FIG. 3 represents a graph showing the relationship between the theoretical Mach number and pressure in the decarburizing vessel.

In a lance having a nozzle with a smaller diameter than that of the lance, it is known that when the pressure in the lance is about twice as much as that in the vessel, the flow rate is linearly proportional to the pressure in the lance and the sectional area of nozzle throat. It is also known that the theoretically attainable Mach number at the exit of the nozzle is determined only by the pressure in the lance and that in the vessel. From these facts, the following equation applies:

$$P_2 = P_0/(1 + \frac{K-1}{2} M_2^2)\, k/(k-1) \qquad (1)$$

wherein $P_0$, $P_2$, $M_2$ and $k$ have each the following definition:

$P_0$: Pressure in the lance (kg/m², absolute)
$P_2$: Pressure in the vessel (kg/m², absolute)
$M_2$: Mach number at the nozzle exit
$k$: ratio of specific heat at constant pressure and constant volume This relation is also illustrated by FIG. 3.

However, the shape of nozzle is determined only by the Mach number of jet at the nozzle exit. As shown in the following equation:

$$\frac{A_1}{A_2} = \frac{M_2}{M_1} \quad \frac{1 + (k-1) M_{1/2}^2}{1 + (k-1) M_{2/2}^2} (k+1)/2(k-1) \qquad (2)$$

wherein $A_1$: Sectional area at the throat $A_2$: Sectional area at the nozzle exit $M_1$: Mach number at the throat, $M_1 = 1$ $M_2$: Mach number at the nozzle exit K: Ratio of specific heats at constant pressure and constant volume.

Figure 4:
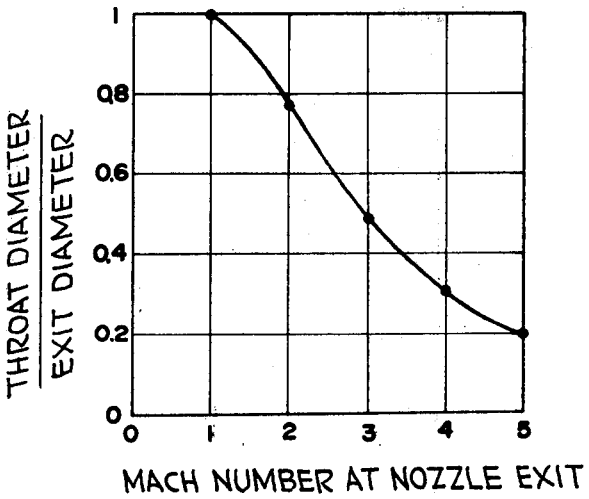
FIG. 4 represents a graph showing the relationship between the designed Mach number and the divergence of the Laval nozzle.

This relation is also illustrated in FIG. 4.

Figure 5:
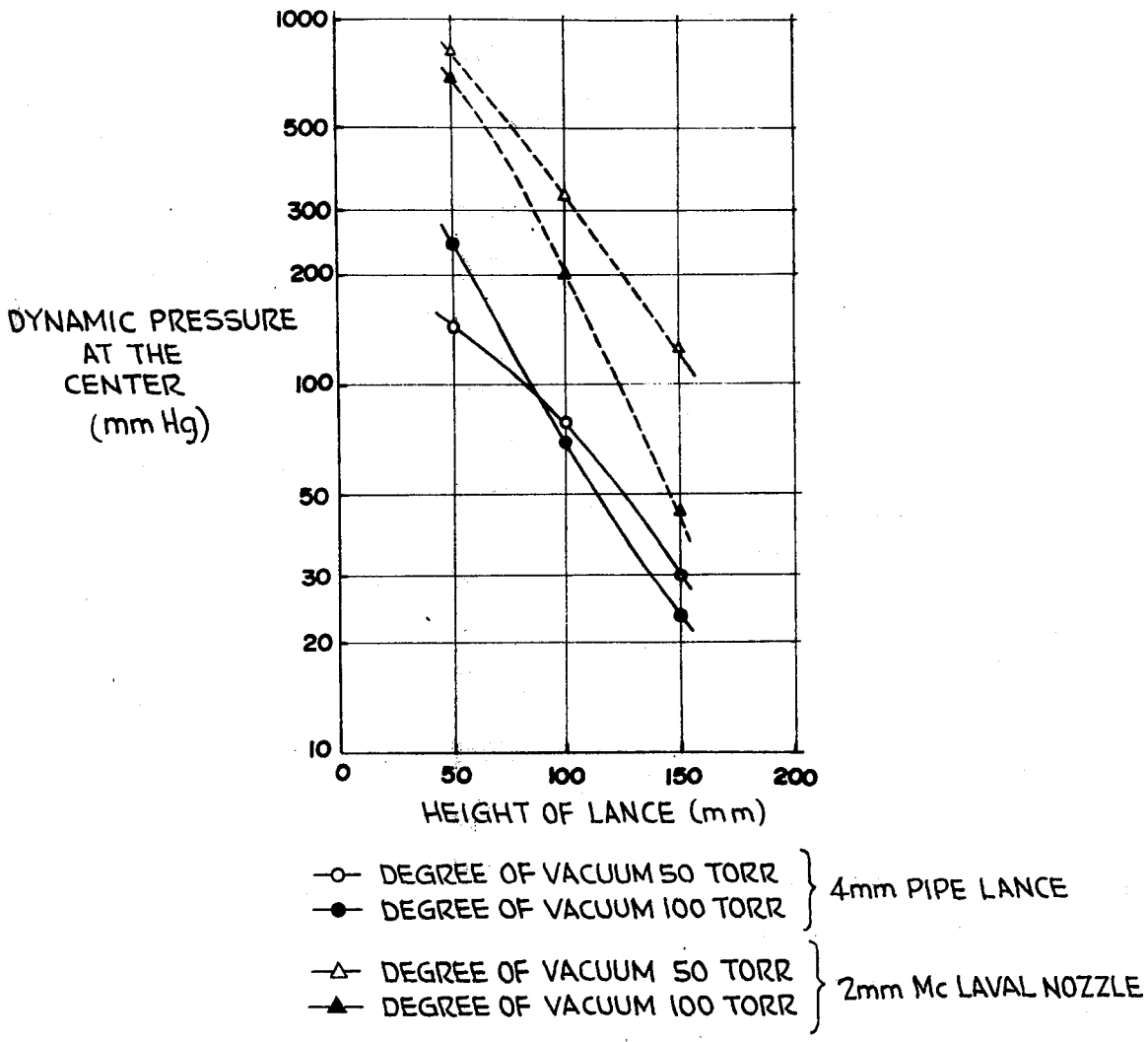
FIG. 5 illustrates the relationship between dynamic pressure at the center of the oxygen jet and the height of the lance with two different diameters of the lance and at two different vessel pressures.

As a result of an extensive study by the inventors, it has been found to be important how to determine the three variables comprising the diameter of the nozzle throat defined by the designed oxygen flow rate, the pressure in the lance and Mach number defined by the pressure values in the lance and in the vessel and how to deal with the fluctuation of the Mach number resulting from the varied pressure in the vessel during the course of decarburization. An experimental 10-ton Witten plant was operated by employing a lance of the consuming type having an inner diameter of 21 mm, blowing oxygen in an amount of 180 to 300 $Nm^3/hr$ and initially placing the lance at a height of 300 mm. The inventors measured the dynamic pressure of the oxygen jet in an evacuated model test plant which was prepared so that the monodimensional scale is 1/5 of the experimental decarburizer and the flow rate of oxygen is designed to be 1/25. A nozzle having an inner diameter of 4 mm was employed as a model of the pipe lance. Oxygen at a flow rate of $10Nm^3/hr$ was passed from the pipe lance through a throat having a diameter of 4, 3 or 2 mm and a straight of Mach number pipe with a 1 and a Laval nozzle having a designed Mach number from 2 to 4 aligned so as to strengthen the dynamic pressure. FIG. 5 illustrates the relationship between the central dynamic pressure of the jet and height of the lance and a comparison of the central dynamic pressure produced in such nozzles at a lance height of 100 mm for example.

Figure 6:
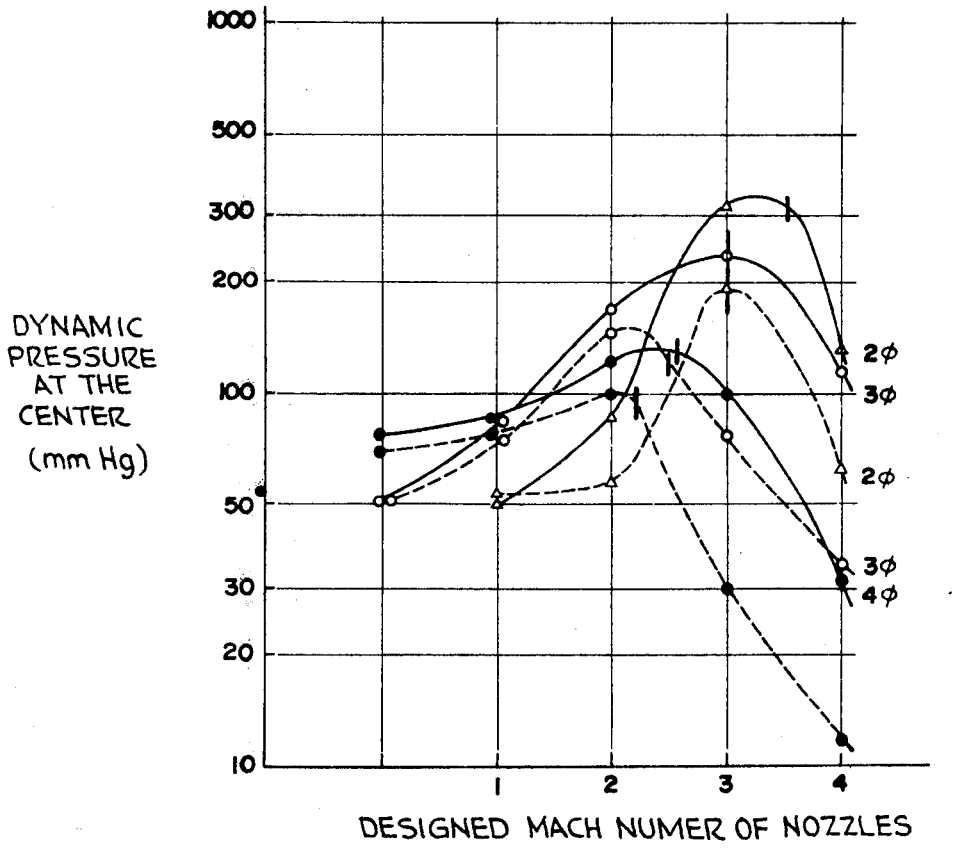
FIG. 6 is a graph showing the relationship between dynamic pressure at the center of the oxygen lance placed at a height of 100 mm and the design Mach number of the Laval nozzle.

As shown in FIG. 5, it is found that in comparison with a pipe nozzle, the dynamic pressure is enhanced markedly in the Laval nozzle wherein the throat diameter is reduced to 2 mm and the Mach number is designed to be 3. In other nozzles, since the central dynamic pressure is reduced substantially exponentially with the increased height of the lance as compared with the value of central dynamic pressure for the nozzle at a lance height of 100 mm as representative, the dynamic pressure increases progressively with the increased Mach number of nozzles as shown in FIG. 6. Over a certain designed Mach number, the dynamic pressure tends to decrease rapidly. The Mach numbers indicated by the solid bars in FIG. 6 are the theoretically attainable Mach numbers at the exit which are determined from the pressure values in the lance and in the vessel. It has been found that the maximum dynamic pressure can be achieved by nozzles which have been designed to have the designed Mach numbers which correspond substantially to the theoretically attainable Mach numbers.

If the designed Mach number is either smaller or larger than the theoretical Mach number, the dynamic pressure will decrease. It has been found that the drop in the dynamic pressure is striking especially when the designed Mach number is excessively large. From the result obtained at the height of lance as previously tested in the Witten process, the oxygen lancing may be preferably carried out under that condition employing a Laval nozzle having a Mach number designed in accordance with the upper limit of the variance in the pressure in the vessel during the oxygen lancing and under conditions so as to allow the designed Mach number to be smaller than the theoretical Mach number at the exit during the period when the pressure in the vessel is lower than the upper limit.

Since the diameter of the nozzle throat is determined from the desired flow rate of oxygen and pressure in the lance, it is possible to reduce the diameter of the nozzle throat to such an extent so as to be balanced with the pressure in the lance under structurally obtainable conditions. When the pressure in the lance is excessively high, it may be reduced to some extent and the diameter of the nozzle throat is correspondingly increased.

The present invention will be now illustrated by the following examples.

EXAMPLE 1

Stainless steel containing initially 0.30 to 0.35% of C, 0.15to 0.20% of Si, 1.6 to 1.8% of Mn, 18.5 to 19.0% of Cr and 8.0 to 8.3% of Ni was lanced with oxygen in a 10-ton Witten decarburizer. The pressure in the vessel fluctuated from 100 to 10 Torrs during the decarburization. The pipe lance was steel pipe having an inner diameter of 21 mm and coated with zirconia mortar thereon. The lance was set at a height of 300 mm at the initiation of lancing and the advance of the lance slowed down gradually as the lancing proceeded. The flow rate of oxygen was 250 $Nm^3/hr$ for the initial 20 minutes and 200 $Nm^3/hr$ for the last 15 minutes when the pressure in the vessel was less than 30 Torrs.

The steel product after the decarburization had the following composition:

C 0.023%; Si 0.09%, Mn 1.15%; Cr 18.03%; Ni 8.22%.

EXAMPLE 2

The decarburization was repeated as in the procedure of Example 1 except that the lance was modified as follows. The lance employed had a Laval nozzle with a throat diameter of 10 mm, an exit diameter of 20.5 mm and a divergence of 60 mm and a designed Mach number of 3. Since the lance was designed so that the pressure in the lance was 5.2 $kg/cm^2$ at an oxygen flow rate of 250 $Nm^3/hr$ and the theoretical Mach number at the exit was obtained at 100 Torrs at the initiation of decarburization which corresponded to the designed Mach number of the nozzle, the latter number is smaller than the former number at pressures lower than 100 Torrs. When the flow rate of oxygen at the completion of lancing was reduced, the pressure in the lance was 5.2 $kg/cm^2$ and that in the vessel was less than 30 Torrs, thus the condition was satisfied that the designed Mach number be less than the theoretical Mach number at the exit.

When the lance with the aforesaid Laval nozzle was mounted at a height of 700 mm and lancing was performed without adjusting the height of the lance during the decarburization, the components of decarburized steel were as follows:

C 0.02%; Si 0.10%; Mn 1.20%; Cr 18.15%; Ni 8.10%.

Thus the composition of decarburized steel was substantially the same as that obtained with the lance pipe of the consuming type.

EXAMPLE 3

When the oxygen was carried out under the same conditions as those in Examples 1 and 2 by employing a pipe lance and mounted at a height of 700 and without adjusting it during the lancing, the decarburized steel had the following composition:

C 0.14%; Si 0.12%; Mn 1.33%; Cr 18.40%; Ni 8.18%.

Obviously the decarburization was effected insufficiently and it was confirmed that oxygen was used ineffectively.

When a Laval nozzle is employed, the vertical distance from the tip of the lance to the molten steel surface can be extended, for example, more than twice as high as that of a conventional lance. When the lance is maintained constantly at such a height, for example, 1400 mm during the lancing, the dynamic pressure or depth of depression on the molten steel caused by the oxygen pressure can be maintained to values equivalent to the conventional lancing at an initial height of 600 mm. During the oxygen lancing, the closed decarburization vessel is evacuated to a desired degree of vacuum by means of exhausting facilities comprising steam ejectors, condensors and the like. The waste gas from the exhausting facilities is discharged into the atmosphere through the flue. A portion of the waste gas is drawn continuously from the midpoint of flue to be analyzed continuously by means of a paramagnetic oxygen analyser for $O_2$ and an infra-red gas analyser for CO and $CO_2$.

Figure 7:
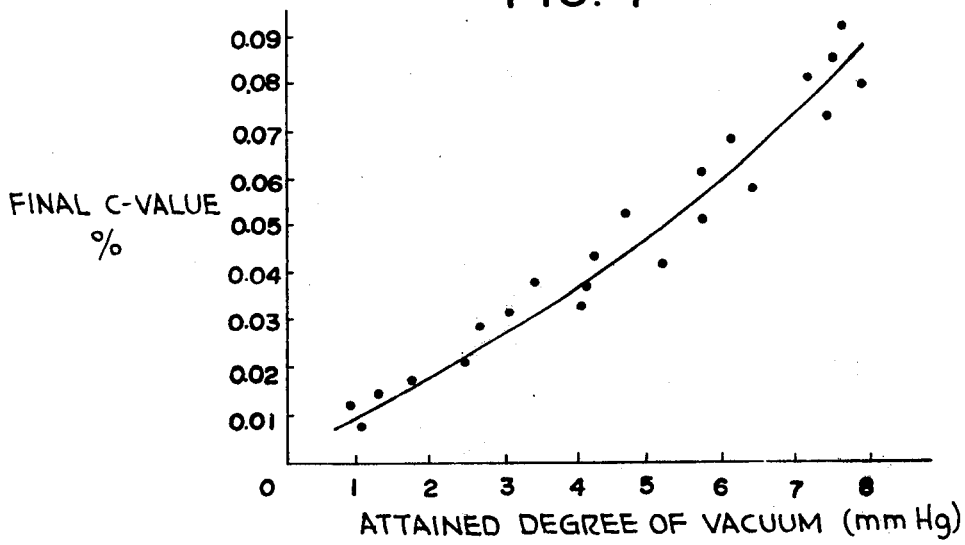
FIG. 7 shows a curve showing the relationship between the achieved degree of vacuum and the final C-value in the decarburization of steel corresponding to 18Cr - 8Ni steel.

As a result of flowing the oxygen from a height of twice or higher than that for conventional lancing, no loss occurs at all in the lance during the vacuum decarburization and the lance requires no control of the height. Also the fluctuation of decarburization caused hithertofore by the effect of unburned oxygen gas liberated by the exhuastion of lance is eliminated. Hence at the time when the waste gas amount is reduced at the completion of decarburization, the waste gas contains substantially only CO and $CO_2$. The content of (CO + $CO_2$) is maintained constant by the marked reduction of fluctuation during the heating. As shown in FIG. 7, the final C-value corresponds well with the attained degree of vacuum to estimate prematurely and correctly the final C-value form the attained degree of vacuum.

EXAMPLE 4

18 Cr-8Ni stainless steel was decarburized in vacuum in a 50-ton vacuum refining plant using an oxygen lance with a Laval nozzle. The molten steel prior to the oxygen lancing had the following composition: C 0.38%; Si 0.30%; Mn 1.20%; P 0.029%; S 0.007%; Ni 9.4%; Cr 18.8%; Fe The flow rate of oxygen and argon and degree of vacuum were changed stepwise as shown in the following table:

Table 1

| Step No | Amount of oxygen flowing out | Amount of oxygen for lancing | Amount of argon | Degree of vacuum |
|---|---|---|---|---|
| 1 | 0–200 $Nm^3$ | 1,000 $Nm^3$/hr | 20 N1/min. | 60–100mm Hg |
| 2 | 200–300 $Nm^3$ | 1,000 $Nm^3$/hr | 80 N1/min. | 30–40 mm Hg |
| 3 | More than 300 $Nm^3$ | 800 $Nm^3$/hr | 40 N1/min. | Less than 10 mm Hg |

The lance height was kept constantly at 1400 mm during the oxygen lancing.

The oxygen lancing was stopped at the time when the degree of vacuum attained was 6 mm Hg based on FIG. 7 with the intention of making the final C-value 0.06%. The molten steel at the completion of decarburization had the composition substantially as desired namely C 0.064%; Si 0.12%; Mn 0.88%; P 0.029%; S 0.007%; Ni 9.70%; Cr 18.40%; and the balance being Fe.

Figure 8:
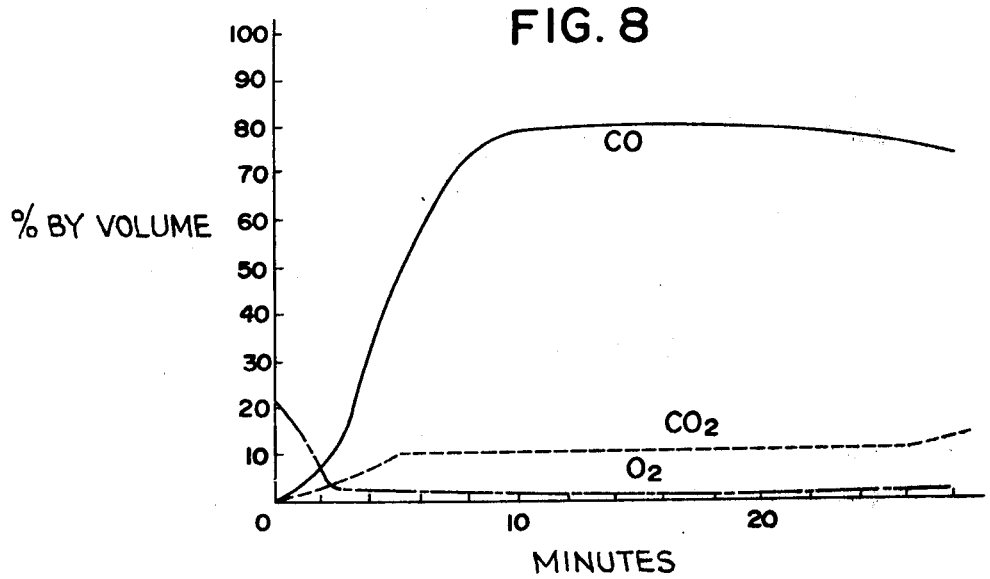
FIG. 8 shows the percentage volume of CO, $CO_2$ and $O_2$ during the lancing process.

In this lancing, no loss of the tip of the oxygen lance occured at all and as shown in FIG. 8, CO gas in the waste gas was stabilized at a higher level, $CO_2$ gas at a relatively lower level and $O_2$ gas at a level substantially close to zero in the course of decarburization. Thus the curves prove satisfactory efficiency for the decarburization and satisfactory removal of silica and stabilized decarburization so that the final C-value can be realized correctly by the degree of vacuum and the process according to the present invention can control the decarburization extremely correctly.

Figure 9:
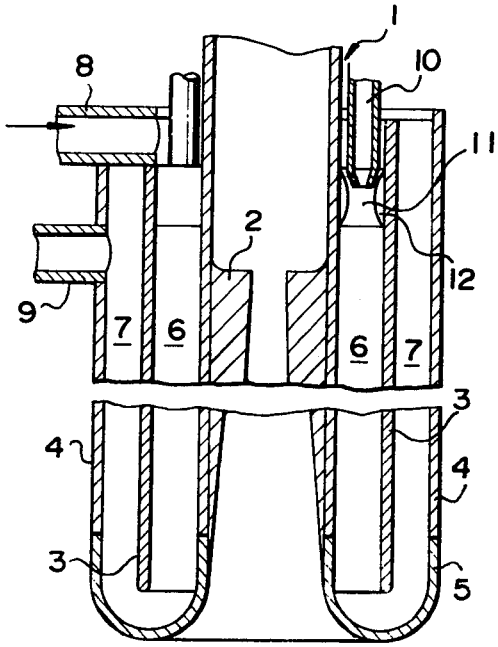
FIG. 9 shows a cross sectional view of a Laval nozzle equipped with water cooling means taken along line IX—IX of FIG. 10.
Figure 10:
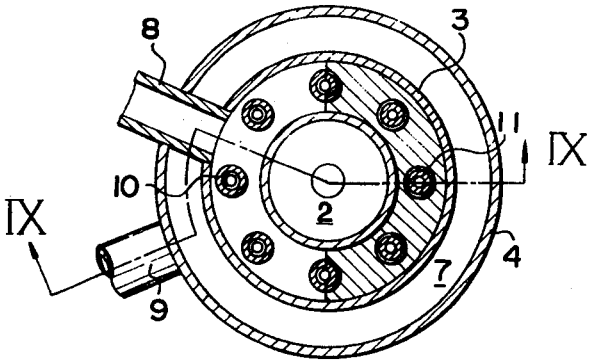
FIG. 10 is a cross sectional view of a Laval nozzle.

Another embodiment of the lance is illustrated in FIG. 9 and 10 which has a Laval nozzle equipped with water cooling means.

Laval lance 1 comprises generally triple tubes including an inner tube defining the passage for lancing oxygen and has a throat 2 and an outer tube 4 which is divided into two parts by means of a partition tube 3. The tips of outer and inner tubes are closed annularly with an annular copper ring or the like to define the tip of nozzle 5. The partition tube is spaced from the tip end portion of the nozzle 5 and provides inner and outer passages 6, 7 for passing the cooling medium. The medium enters from an inlet 8 to the inner passage 6 to descend along the wall of inner tube 2, passes from the tip nozzle 5 to the outer passage 7 to ascend along the inner wall of outer tube 4 and exists from outlet 9.

Further, a pipe 10 is mounted at the upper portion of inner passage 6 for feeding the cooling medium (cooling air) which has a nozzle 11 for spraying the cooling liquid upsteam of the passage. The inner passage 6 is throttled to define a contracted portion 12 around nozzle 11, through which the flow rate of cooling air is enhanced to impart the complete atomization of the liquid.

A 10-ton vacuum refining plant was equipped with a lance comprising an outer tube having a diameter of 4 inches and an inner tube, an oxygen lancing tube having a diameter of 1½ inches and a total length of 1600 mm and provided with a nozzle 11 for spraying cooling water having a diameter of 2.5 mm at a height of 700 mm from the tip 5 of the nozzle to the molten steel surface so that a portion of the lance heated in the furnace had a length of 500 mm. The oxygen lancing was carried out with cooling air in fed from the inlet 8 at a rate of 150 $Nm^3$/hr and cooling water is fed from the water tube 10 at a rate of 180 L/hr. The lance lasted without any trouble for a lancing period of 25 minutes. The molten steel has a temperature from 1690 to 1770° C at the finished lancing period. The lance could be employed a number of times repeatedly for the oxygen lancing.

Because of the structure and the function of the oxygen lance, the present invention has the following advantages:

1. No labor is required for the operations such as adjusting progressively the height of the lance during the oxygen lancing as in the case of conventional lances of the consuming type.
2. The loss of the lance by burning can be prevented.
3. Loss of expensive Cr, Mn and the like can be minimized and the oxygen content in the decarburized steel is lessened due to an improvement in the final C-value, so that steel of excellent quality can be produced inexpensively.

4. The refining temperature is not requiredto be excessively high and the refractoriness life can be prolonged considerably.
5. The refining period can be reduced to improve the efficiency.
6. There are no adverse effects caused by the leakage of water and the durability of the plant including the lance is improved.

What is to be claimed are:

1. A process for the vacuum decarburization of steel under reduced pressure by mounting a ladle filled with molten steel in a closed decarburization vessel and agitating the molten steel by blowing gas through a tuyere in the ladle to prevent oxidation of alloy metals in the low carbon range, the improvement comprising the steps of:

blowing lancing oxygen through an oxygen lance using a laval nozzle having a nozzle exit Mach number in the range of 2 – 4 wherein the laval nozzle has a divergent passage from its throat to its tip;

maintaining the laval nozzle at a fixed height above the surface of the molten steel; and controlling the flow rate of oxygen in accordance with variations in the presence within the vessel to maintain the Mach number in the above specified range in accordance with the following formula:

$$P_0 = P_2/(1 + \frac{-K-1}{2} M_2^2)\, k/(k-1)$$

wherein $M_2$ is the Mach number at the nozzle exit;

$P_0$ is the pressure in the lance in Kg/m², absolute, $P_2$ is the pressure in the vessel (kg/m², absolute), and $K$ is the ratio of specific heats at constant pressure and volume.

2. A process as in claim 1 wherein the divergence of the laval nozzle is determined from the following formula:

$$\frac{A_1 = M_2}{A_2 \quad M_1} \; \frac{1 + (k-1)\, M_1^2/2}{1 + (k-1)\, M_2^2/2}\; (k+1)/2(k-1)$$

wherein $A_1$ = sectional area at the nozzle throat $A_2$ = sectional area at the nozzle exit $M_1$ = Mach number at the nozzle throat and $M_1 = 1$.

3. A process as in claim 2 further including the step of mounting the tip of the laval nozzle at a height of substantially 1400 mm above the surface of the molten steel and maintaining that elevation during the decarburization process.

4. A method as in claim 1 further comprising the step of cooling the oxygen lance with a liquid spray.

5. A method as in claim 1 further including the step of mounting the tip of the laval nozzle at a minimum height of 700 mm above the surface of the molten steel and maintaining that elevation of the laval nozzle during the decarburization process;

providing an oxygen flow rate of 250 Nm³/hr with the pressure in the vessel at substantially 100 torrs at the initiation of decarburization; and reducing the flow rate of oxygen to substantially 200 Nm³/hr with the pressure in the vessel less than 30 torrs.

* * * * *